US005768732A

United States Patent [19]

Blanc

[11] Patent Number: 5,768,732

[45] Date of Patent: Jun. 23, 1998

[54] DEVICE FOR ASSEMBLING THE UPPER AND SOLE OF A SHOE

[76] Inventor: Roger Blanc, Route de Virieu, 38730 Le Pin, France

[21] Appl. No.: 761,076

[22] Filed: Dec. 17, 1996

[30] Foreign Application Priority Data

Dec. 18, 1995 [FR] France ..... 95 15207

[51] Int. Cl.[6] ..... A43D 11/00

[52] U.S. Cl. ..... 12/1 A; 12/1 W

[58] Field of Search ..... 12/1 A, 1 R, 1 W

[56] References Cited

U.S. PATENT DOCUMENTS

| | | | |
|---|---|---|---|
| 3,024,480 | 3/1962 | Baker et al. | 12/1 A |
| 4,304,020 | 12/1981 | Bonnet et al. | 12/1 A |
| 4,765,011 | 8/1988 | Leeper . | |
| 4,769,866 | 9/1988 | Williams | 12/1 A |

FOREIGN PATENT DOCUMENTS

| | | |
|---|---|---|
| 0591596 | 4/1994 | European Pat. Off. . |
| 2566635 | 1/1986 | France . |
| 2705872 | 12/1994 | France . |

*Primary Examiner*—Ted Kavanaugh
*Attorney, Agent, or Firm*—Oliff & Berridge, PLC

[57] ABSTRACT

Device comprising a conveyor designed to transport trays some of which have lasts covered with uppers and soles. The claimed device comprises: a table having several tracks perpendicular to the conveyor and each track is provided with a device for transferring a tray between the conveyor and a remote reference position; the tracks being designed to receive trays with uppers and soles; a transfer robot located on the side of the table opposite the conveyor; a press located on one side of the robot; and a manual station, for assembling uppers and soles, located on the opposite side of the robot.

8 Claims, 4 Drawing Sheets

6
5
4
27
34
30
33
36
35
32
29

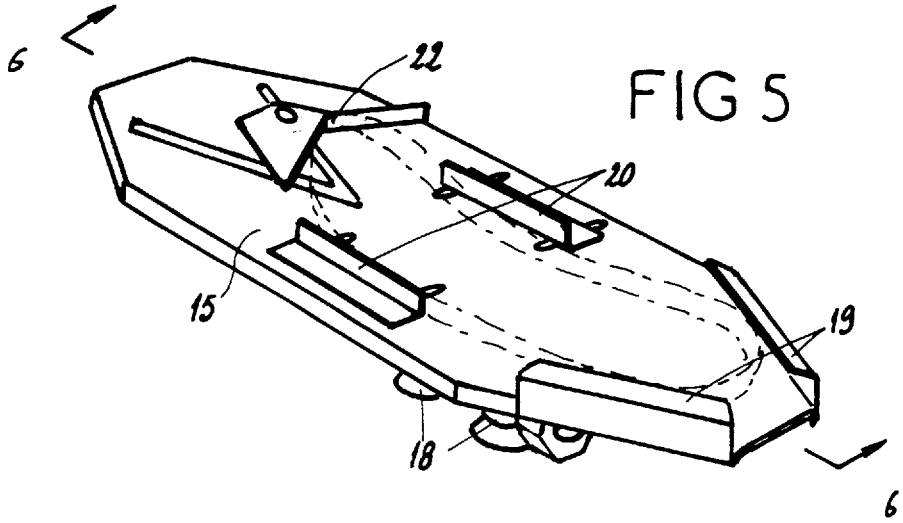
FIG 5
FIG 6
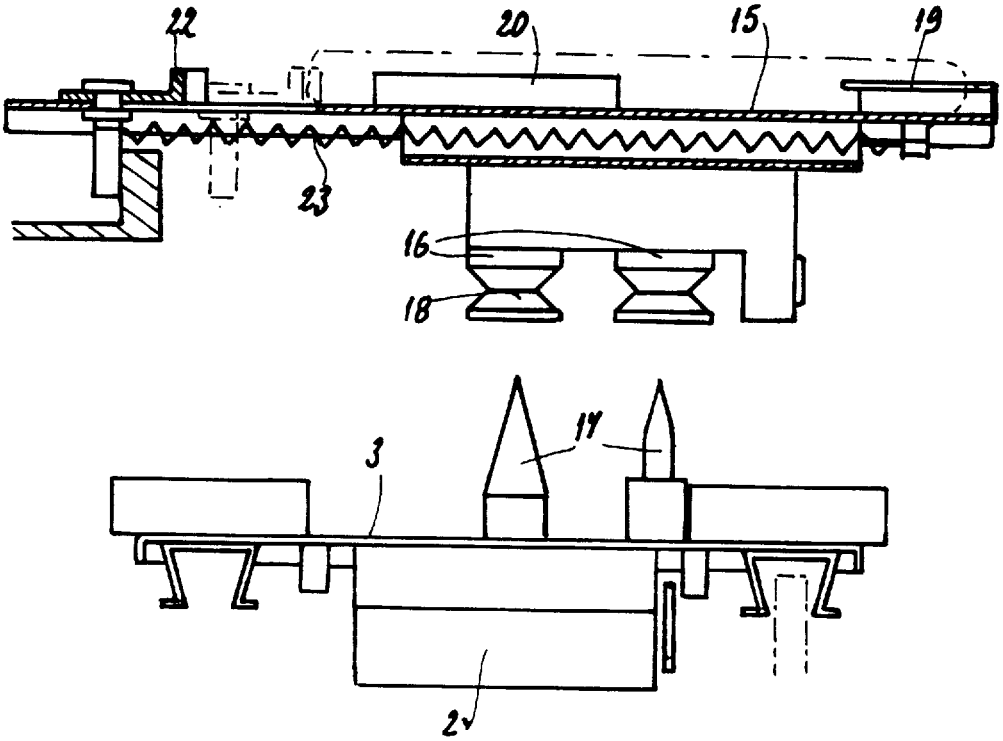

DEVICE FOR ASSEMBLING THE UPPER AND SOLE OF A SHOE

BACKGROUND OF THE INVENTION

1. Field of the Invention

The present invention relates to a device for assembling the upper and the sole of a shoe in an at least partially automated shoe-manufacturing facility.

2. Description of the Related Art

A conveyor is provided in such a shoe-manufacturing facility to transport trays some of which have lasts which are first covered by uppers and other of which carry soles.

SUMMARY OF THE INVENTION

The goal of the invention is to provide an assembly device that offers a maximum number of shoemaking options, allowing fully-automatic assembly of shoes whose soles are simple in shape, such as a dish shape, while at least partially manual assembly can be used for other types of shoes whose soles are more complex.

For this purpose, the device to which it relates has:

- a table having several tracks perpendicular to the conveyor, each of said tracks being provided with a device for transferring a tray between the conveyor and a reference position remote therefrom, said tracks being designed to receive trays carrying uppers and soles to make several pairs of shoes,
- a transfer robot located on the side of the table opposite the conveyor,
- a press located on one side of the robot, and
- a manual assembly station for assembling uppers and soles, located on the other side of the robot.

The trays are identified by a memory device indicating the type of product it carries, upper or sole, and also the assembly method for the product—automatic assembly or manual assembly. A computer associated with the system then commands the robot either to perform manual assembly or to transfer the upper to the manual assembly station.

Advantageously, the table is equipped, in each area corresponding to the reference position of a tray carrying a sole, with hooks mounted on cylinders forming spreaders designed to open the edge of the sole to facilitate mounting of the upper thereon.

According to one characteristic of the invention, in the case of lasts allowing simple assembly of the upper and sole, the control means trigger the following sequence: the arm of the robot grips a last equipped with an upper, inverts it, and moves it to the sole against which the last and the upper are applied after the edges of the sole have been spread; the assembly thus obtained when the glue that has been applied locally to the sole and/or upper is reactivated when the plates arrive at the table; it is then transferred by the robot to the press which holds the assembly by pressure while the glue dries before a further transfer of the tray, said tray having originally served to deliver the last provided with the upper.

In addition, the press has at least one support provided with means for receiving the last equipped with the upper and the sole, which means are identical to those provided for the trays designed to transport the lasts.

The last-receiving means can be made for example of two vertical shaped fingers, while the last is equipped with two matching tubular elements, each tubular element possibly having, at its periphery, at least one groove to be gripped by the robot arm.

According to another characteristic of the invention, the station where an upper and a sole are manually assembled has a column attached to the floor, on the upper part of which a board is mounted to pivot under the influence of a cylinder between a horizontal position and a substantially vertical position, said board bearing a support provided with means for receiving the last equipped with the upper, said means being identical to those provided for the trays designed to transport the lasts and means for locking the last.

The robot brings the last equipped with the upper, while the board of the assembly station is in the horizontal position. The operator triggers pivoting of this board into the vertical position so that the sole can be more easily assembled to the upper.

To facilitate this operation, the board is also mounted to pivot around an axis which is perpendicular thereto, and is associated with a rotating cylinder designed to ensure its return movement to the reference position, after assembly of the sole and the upper, to allow it to be gripped by the arm of the robot.

The operator can then cause the board and the last mounted thereon to pivot freely around this second axis to effect the assembly of the sole. When this assembly is complete, the operator need only activate a control which, because of the rotating cylinder and the cylinder pivoting around a horizontal axis, causes the board to return to the horizontal position, with indexing in the reference position for the upper plus sole assembly to be gripped by the robot arm.

It is important, in view of the various movements to which the upper can be subjected, to fully immobilize the last carrying the upper on the board, said immobilization being achieved for example by action of the rod of a cylinder whose end penetrates into a notch provided in the last, particularly in a tubular element supporting this last. It is also important for the position of each sole arriving at the table to be perfectly identified as a function of the size of the sole.

For this purpose, each sole rests on a plate itself mounted on a tray with the aid of the same positioning means as those used for the lasts, said plate having on its upper face a fixed rear stop, two side stops, and one front stop which is movable lengthwise and is subjected to the action of springs tending to displace it rearward.

The position of each sole is thus determined by reference to the position of its heel, which is always the same whatever the size of the sole.

BRIEF DESCRIPTION OF THE DRAWINGS

In any event, the invention will be thoroughly understood with the aid of the description hereinbelow with reference to the schematic drawing attached which shows, as a nonlimiting example, one embodiment of this device:

FIG. 5 is a perspective view of the supporting plate of the sole;

FIG. 6 is a lengthwise view along line 6—6 in FIG. 5, shown of a carrying tray.

DETAILED DESCRIPTION OF THE PREFERRED EMBODIMENT

Figure 1:
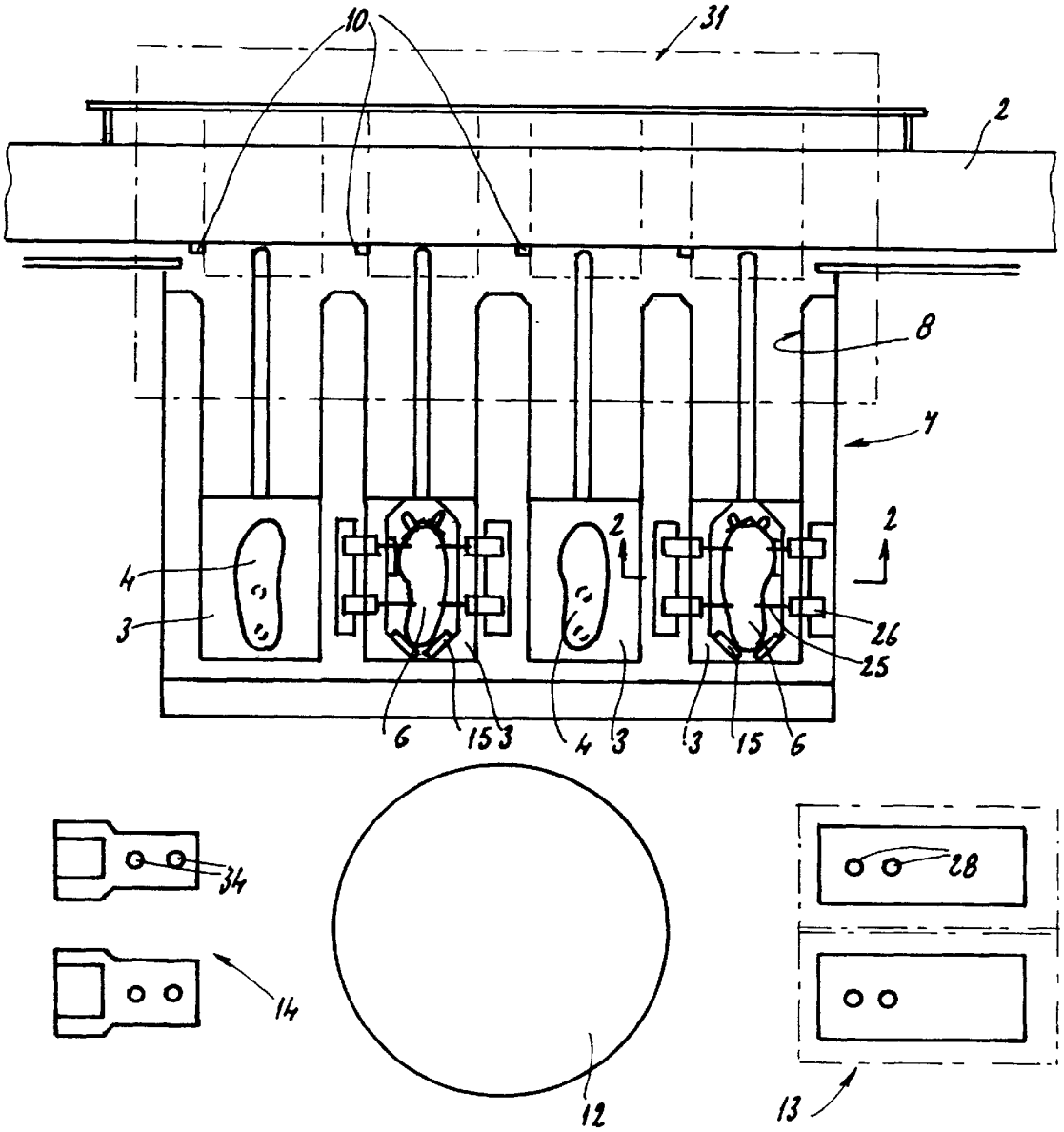
FIG. 1 is a top view of this device.

The device according to the invention is associated with a conveyor 2 designed to carry trays 3, some of which carry lasts 4 covered with uppers 5, and others of which carry soles 6.

The device has a table 7 that has four tracks 8 perpendicular to the conveyor and each provided with a transfer device 9 which has in particular a cylinder, this device being able to move a tray 3 between the conveyor, where tray 3 is immobilized by stops 10, and a reference position remote from the conveyor. The transfer device is also intended to move in the reverse path to the tray, namely from the reference position remote from the conveyor, up to the conveyor.

The device shown in FIG. 1 has a table 7 provided with four tracks 8, so that four trays may be present simultaneously on the table, two of which carry lasts 4 and two of which carry soles 6.

On the side of the table opposite the conveyor a robot 12 is provided on either side of which are mounted a press 13 with two assembly areas and a manual assembly station 14 with two assembly areas.

Each sole 6 rests, not directly on a tray 3, but on a plate 15. Each plate 15 is provided with two tubular parts 16 that project downward to fit onto two fingers 17 that project from the upper face of a tray. In their lower parts, tubular elements 16 have grooves 18 for gripping by the arms of robot 12.

Plate 15 has, as shown particularly in FIG. 5, fixed stops 19 at the rear to immobilize the heel, adjustable side stops 20, and a front stop 22 displaceable rearward by means of a spring 23. As a result, the position of each sole 6 as a function of the size of the sole is determined by the position of its heel since it is heel stop 19 that is the fixed reference point.

Figure 2:
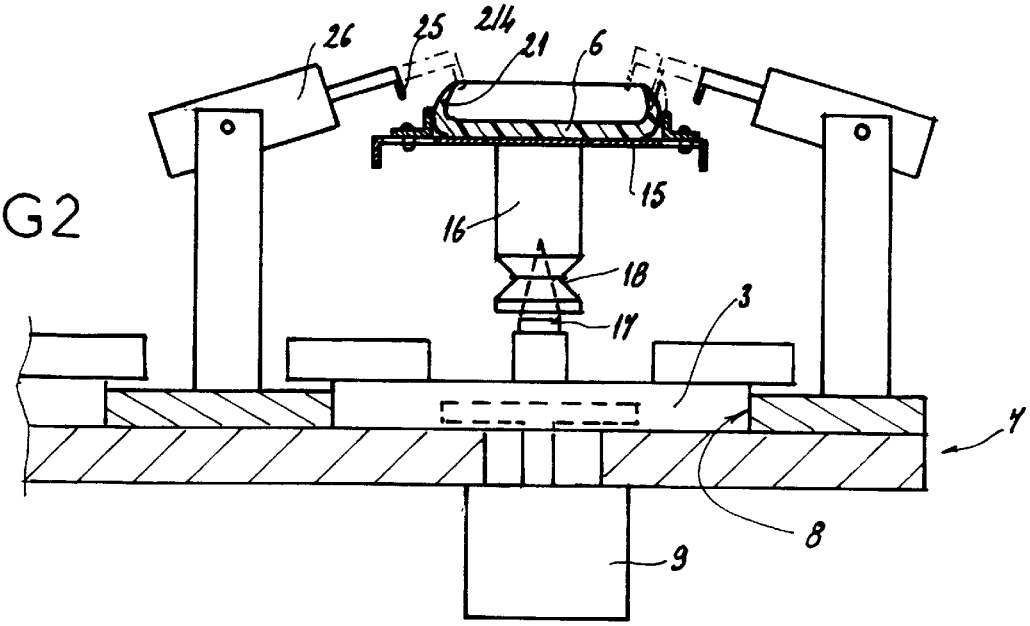
FIG. 2 is a partial view, on an enlarged scale, along line 2—2 of FIG. 1.
Figure 3:
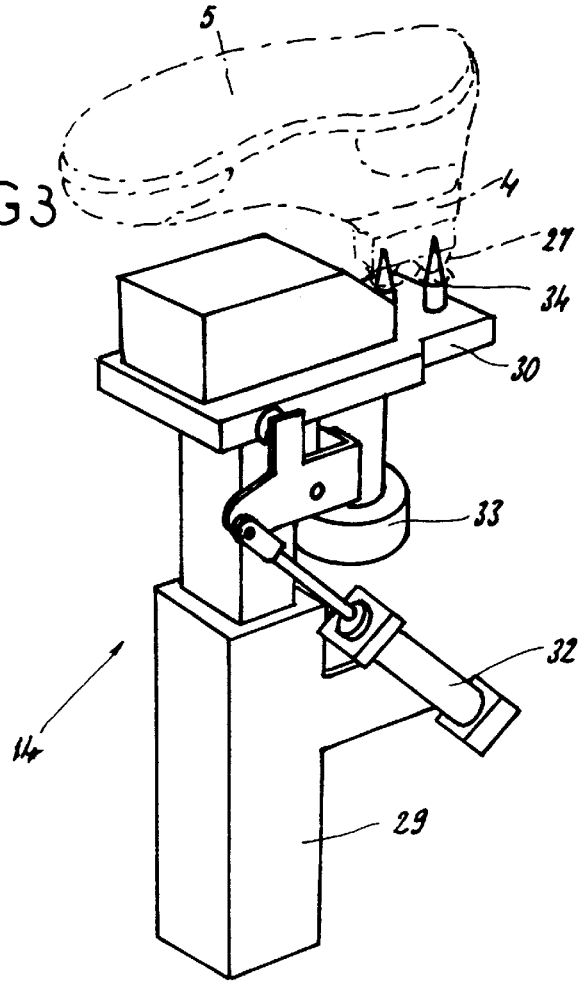
FIG. 3 is a perspective view of a manual assembly station.

As shown in FIG. 2, each track 8 designed to receive a tray 3 equipped with a sole 6 is associated with hooks 25 mounted on cylinders 26, forming spreaders able to move edge 21 of a sole which has a general dish shape, outward. When the lasts of upper 5 and a corresponding sole 6 are sufficiently simple, assembly can be effected automatically. For this purpose, the robot grips last 4 by tubular parts 27 (shown in FIG. 3) thereof fitting onto fingers 17 of tray 3, turns the last over, and applies it, equipped with upper 5, onto sole 6. In view of the reactivation of the glue inside an oven 31 as the trays are brought to table 7, adhesion occurs between the sole and the upper. To perfect this adhesion, the assembly is transferred by robot 12 to press 13 where the last is engaged by means of its tubular parts 27 on fingers 28 analogous to fingers 17 of trays 3. During the phase in which the sole is pressed onto the upper, the robot proceeds with another operation, for example transferring the last+upper+sole assembly from the area near the press to a free tray 3 in order to carry away the assembly thus produced to the next station.

Figure 4:
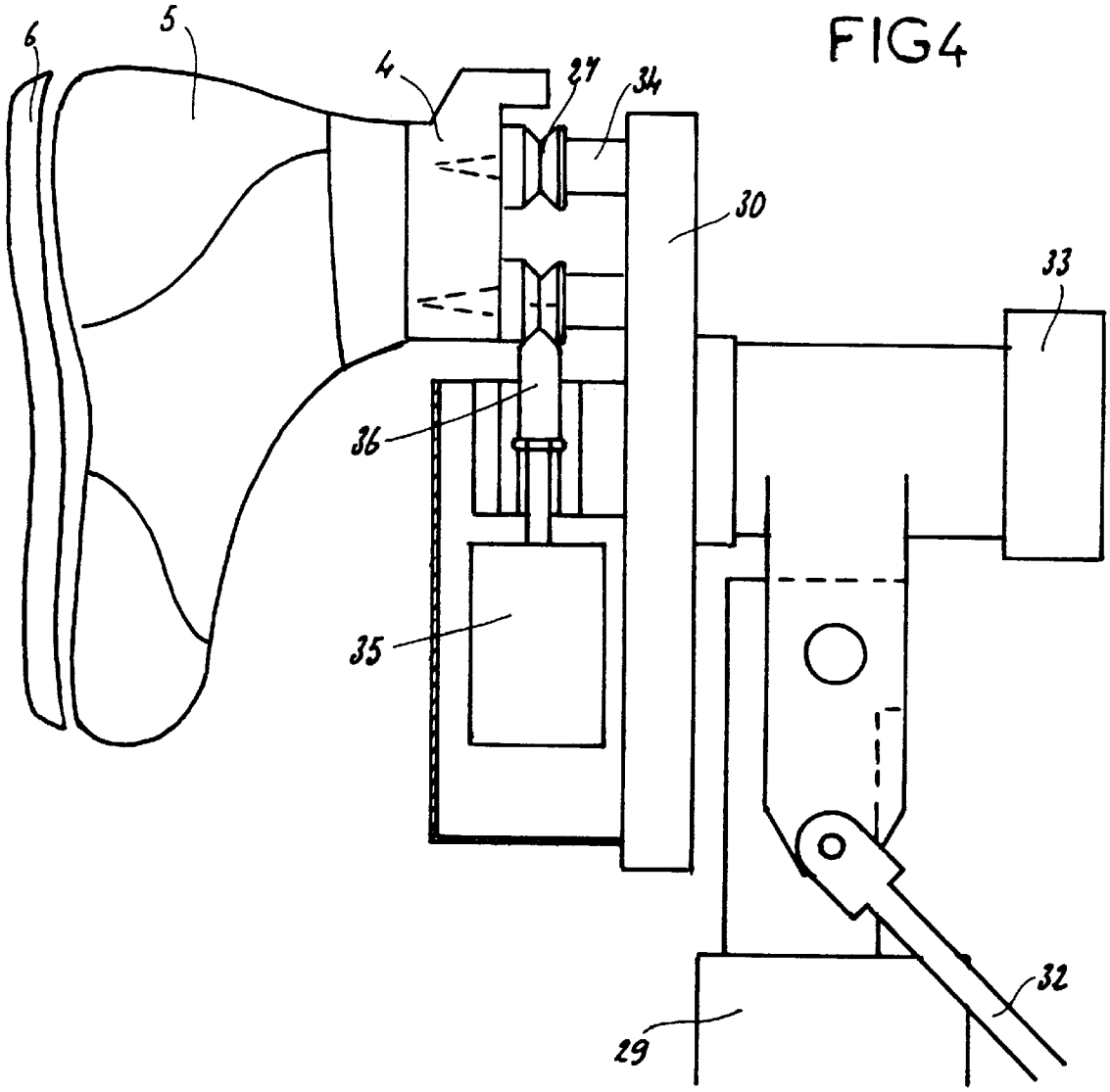
FIG. 4 is a side view on an enlarged scale of the same manual assembly station in a second utilization position.

If the shapes of the upper and/or the sole are complex, manual assembly is possible. For this purpose, robot 12, under the conditions indicated above, transfers the last and the upper to manual assembly station 14. The latter has a vertical column 29 on the upper part of which is mounted a board 30. This board 30 can pivot between a horizontal position shown in FIG. 3 to a vertical position shown in FIG. 4 by means of a cylinder 32. This board 30 can also pivot about an axis perpendicular thereto, this second pivoting movement being associated with a rotating cylinder 33. Board 30 has two fingers 34 analogous to fingers 17 of trays 3, designed to receive last 4. In practice, last 4 is brought to the board in the position of FIG. 3. The operator then actuates cylinder 32 which brings the board into the vertical position. In this position, the board can rotate freely about its second axis which is now horizontal, allowing the operator to assemble the sole, said sole being provided to the operator in a box for example, or being brought by robot 12. To prevent the last from escaping the board, a locking cylinder 35 is provided, the end of whose rod is equipped with a tip 36 penetrating into a groove of a tubular element 27 of the last. After the sole has been assembled on the upper, the operator causes the last+upper+sole assembly to return to the original position shown in FIG. 3, this memorized position being obtained by means of the movements of cylinders 32 and 33.

The arm of the robot then takes back the assembly, bringing it to a tray 3 waiting in the storage area, said tray being carried away by cylinder 9 to conveyor 2 for continued manufacture of the shoe.

As can be seen from the above, the invention provides a considerable improvement to existing technology by providing a device designed to assemble a shoe upper and a sole, of simple design, offering a plurality of utilization options, and allowing the work of the robot to be optimized.

It goes without saying that the invention is not confined to the embodiment of this device described above as an example; on the contrary it embraces all variants thereof. Thus, in particular, the number of tracks on the table could be different, or the means for displacing each tray on a track could be different, without thereby departing from the framework of the invention.

I claim:

1. Device for assembling an upper and a sole of a shoe, in an at least partially automated shoe-manufacturing facility, comprising:

a conveyor designed to transport trays some of which have lasts covered by uppers and others have soles, a table having several tracks perpendicular to the conveyor, each of said tracks being provided with a device for transferring a tray between conveyor and a reference position remote therefrom, said tracks being designed to receive trays carrying the uppers and the soles to make several pairs of shoes, a transfer robot located on the side of the table opposite the conveyor, a press located on one side of the robot, and a manual station for assembling the uppers and the soles, located on the other side of the robot.

2. Device according to claim 1 wherein the table is equipped, in each area corresponding to the reference position of a tray carrying a sole, with hooks mounted on cylinders forming spreaders designed to open the edge of the sole to facilitate mounting of the upper thereon.

3. Device according to claim 2, wherein in the case of lasts allowing simple assembly of upper and sole, the control means trigger the following sequence: the arm of the robot grips a last equipped with an upper, inverts it, and moves it to the sole against which the last and the upper are applied after the edges of the sole have been spread; the assembly thus obtained when the glue that has been applied locally to the sole and/or the upper is reactivated when the plates arrive at the table; it is then transferred by robot to press which holds the assembly by pressure while the glue dries before a further transfer of the tray, said tray having originally served to deliver the last provided with the upper.

4. Device according to claim 1, wherein the press has at least one support provided with means for receiving last equipped with the upper and the sole, which means are identical to those provided for the trays designed to transport the lasts.

5. Device according to claim 1, wherein the station where the upper and the sole are manually assembled has a column attached to the floor, on the upper part of which a board is mounted to pivot under the influence of a cylinder between a horizontal position and a substantially vertical position, said board bearing a support provided with means for receiving the last equipped with the upper, said means being identical to those provided for the trays designed to transport lasts, and means for locking the last.

6. Device according to claim 5, wherein the board is also mounted to pivot around an axis which is perpendicular thereto, and is associated with a rotating cylinder designed to ensure its return movement to the reference position, after assembly of the sole and the upper, to allow it to be gripped by the arm of robot.

7. Device according to claim 5, wherein the means by which last is locked are comprised of a cylinder whose end of the rod penetrates into a notch provided in the last.

8. Device according to claim 1, wherein each sole rests on a plate itself mounted on a tray with the aid of the same positioning means as those used for the lasts, said plate having on its upper face a fixed rear stop, two side stops, and one front stop which is movable lengthwise and is subjected to the action of springs tending to displace it rearward.

* * * * *